US009834876B2

(12) United States Patent
Kongo

(10) Patent No.: US 9,834,876 B2
(45) Date of Patent: Dec. 5, 2017

(54) SEWING MACHINE SYSTEM, SEWING MACHINE, TERMINAL DEVICE, METHOD OF DISPLAYING CONTENT FOR SEWING MACHINE SYSTEM, RECORDING MEDIUM STORING PROGRAM FOR SEWING MACHINE, AND RECORDING MEDIUM STORING PROGRAM FOR TERMINAL DEVICE

(71) Applicant: Janome Sewing Machine Co., Ltd., Tokyo (JP)

(72) Inventor: Takeshi Kongo, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 251 days.

(21) Appl. No.: 14/634,634

(22) Filed: Feb. 27, 2015

(65) Prior Publication Data

US 2016/0060799 A1 Mar. 3, 2016

(30) Foreign Application Priority Data

Sep. 3, 2014 (JP) ..... 2014-179418

(51) Int. Cl.
*G06F 7/66* (2006.01)
*D05B 19/02* (2006.01)

(52) U.S. Cl.
CPC ..... *D05B 19/02* (2013.01)

(58) Field of Classification Search
CPC ..... D05B 19/00; D05B 19/02; D05B 19/04
USPC ..... 700/136–138
See application file for complete search history.

(56) References Cited

U.S. PATENT DOCUMENTS 5,247,449 A * 9/1993 Yoshida ..... D05B 69/36 112/277
5,921,194 A * 7/1999 Komuro ..... D05B 19/105 112/102.5
5,996,518 A * 12/1999 Tomita ..... D05B 19/105 112/102.5
6,216,618 B1 * 4/2001 Goldberg ..... D05B 19/02 112/102.5

(Continued)

FOREIGN PATENT DOCUMENTS

CN 203583166 U 5/2014
JP 2003-326026 A 11/2003
JP 2012-200265 A 10/2012

*Primary Examiner* — Nathan Durham
(74) *Attorney, Agent, or Firm* — Nakanishi IP Associates, LLC

(57) ABSTRACT

A sewing machine includes: a status grasping unit configured to grasp an operational status; and an operational code transmitting unit configured to transmit an operational code assigned to the grasped operational status to a tablet terminal. The tablet terminal includes: a display unit; a recording unit recording an operation corresponding content corresponding to the operational code in association with operational codes of a plurality of next options; an operational code receiving unit configured to receive the operational code from the sewing machine; and a display control unit configured to display, in the display unit, the operation corresponding content corresponding to the received operational code, and a list of next option contents corresponding to the operational codes of the next options.

13 Claims, 8 Drawing Sheets

(56) References Cited

U.S. PATENT DOCUMENTS

| | | | | |
|---|---|---|---|---|
| 6,311,097 | B2 * | 10/2001 | Kwak | D05B 19/02 112/102.5 |
| 6,445,970 | B1 * | 9/2002 | Hedman | D05B 19/12 112/445 |
| 6,640,153 | B2 * | 10/2003 | Kwak | D05C 5/02 112/102.5 |
| 8,175,850 | B2 * | 5/2012 | Nelson | G05B 19/406 700/143 |
| 2005/0060058 | A1 * | 3/2005 | Cameron | D05C 5/00 700/138 |
| 2008/0115709 | A1 * | 5/2008 | Wentkowski | D05B 19/02 112/470.01 |
| 2012/0245727 | A1 | 9/2012 | Naka et al. | |

* cited by examiner

Fig. 3

| SCREEN CODE | FILE NAME | StartingToSewEmbroidery.html |
|---|---|---|
| 001 | (100 CHARACTERS) | |
| | NEXT OPTION 01 | 201 |
| | NEXT OPTION 02 | 202 |
| | NEXT OPTION 03 | 320 |
| | ..... | |
| | NEXT OPTION 25 | 521 |

| SCREEN CODE | FILE NAME | EditingMode.html |
|---|---|---|
| 002 | (100 CHARACTERS) | |
| | NEXT OPTION 01 | 211 |
| | NEXT OPTION 02 | 212 |
| | NEXT OPTION 03 | 315 |
| | ..... | |
| | NEXT OPTION 25 | 0 |

. . . . . .

| SCREEN CODE | FILE NAME | CutWorkDesign.html |
|---|---|---|
| 899 | (100 CHARACTERS) | |
| | NEXT OPTION 01 | 812 |
| | NEXT OPTION 02 | 813 |
| | NEXT OPTION 03 | 0 |
| | ..... | |
| | NEXT OPTION 25 | 0 |

SEWING MACHINE SYSTEM, SEWING MACHINE, TERMINAL DEVICE, METHOD OF DISPLAYING CONTENT FOR SEWING MACHINE SYSTEM, RECORDING MEDIUM STORING PROGRAM FOR SEWING MACHINE, AND RECORDING MEDIUM STORING PROGRAM FOR TERMINAL DEVICE

CROSS REFERENCE TO RELATED APPLICATIONS

This application is based on and claims the benefit of priority to Japanese Patent Application No. 2014-179418 filed on Sep. 3, 2014, the contents of which are hereby incorporated by reference in their entirety.

TECHNICAL FIELD

The present invention relates to a sewing machine system having a sewing machine and a terminal device connected in a manner providing a capability of wireless communication with each other, the sewing machine, the terminal device, a method of displaying a content for the sewing machine system, a recording medium storing a program for the sewing machine, and a recording medium storing a program for the terminal device.

BACKGROUND OF THE INVENTION

Sewing machines of these days have become highly sophisticated, making operation of such sewing machines complicated. A typical sewing machine is provided with a large-sized color liquid crystal display unit or the like, and supports a user so as to facilitate learning on how to operate the sewing machine by a graphical user interface, examples of which include representing meaning of buttons by designs of icons and providing a help file in a moving image to be displayed for the sewing machine with. However, not all of the features can be displayed in the display unit, and printed instruction manuals have also been used. In particular, instruction manuals are necessary when a feature is used for the first time, as well as in order to thoughtfully use all features.

However, in a case of paper instruction manuals, it is necessary to have an instruction manual at hand, look up a target item in a table of contents or an index, and flip through pages to find the target item. This is a fairly time-consuming labor.

Further, while keyword search and link features such as in a case of so-called online help are convenient, it is necessary to continue the search by thinking of an appropriate keyword, typing the keyword, and changing the keyword until an appropriate item is found.

On the other hand, conventionally, there is disclosed a system in which a sewing machine and a terminal device are connected in a manner providing a capability of wireless communication with each other, and it is possible to confirm sewing machine related information such as an operational status of the sewing machine on a side of the terminal device (e.g., PTL 1).

However, in the conventional technique disclosed in PTL 1, while the sewing machine related information such as the operational status of the sewing machine may be confirmed on the side of the terminal device, the sewing machine simply discloses such information as available information, and it is necessary to perform operations such as looking up necessary information or specifying an address or the like on the side of the terminal device. Further, according to PTL 1, only an operational status, an error status, operational history, and maintenance information of the sewing machine may be displayed as sewing machine related information in the terminal device.

CITATION LIST

Patent Literature

PTL 1: Japanese Unexamined Patent Application Publication No. 2012-200265

SUMMARY OF THE INVENTION

One or more embodiments of the present invention provide a sewing machine system capable of displaying contents such as operational instructions in a terminal device at appropriate timing according to a status of a sewing machine without requiring complicated operation, the sewing machine, the terminal device, a method of displaying a content for the sewing machine system, a recording medium storing a program for the sewing machine, and a recording medium storing a program for the terminal device.

Embodiment (1)

One or more embodiments of the present invention provides a sewing machine system provided with: a sewing machine; and a terminal device, wherein the sewing machine and the terminal device are connected in a manner providing a capability of wireless communication with each other, the sewing machine includes: a sewing-machine-side wireless communication unit having a capability of wireless communication at least with the terminal device; a status grasping unit configured to grasp an operational status of the sewing machine; and an operational code transmitting unit configured to transmit an operational code to the terminal device, the operational code being assigned to the operational status grasped by the status grasping unit, and the terminal device includes: a display unit; a terminal-side wireless communication unit having a capability of wireless communication at least with the sewing machine; a recording unit recording after associating between the operation corresponding content corresponding to the operational code and, the operational codes of a plurality of next options; an operational code receiving unit configured to receive the operational code from the sewing machine; and a display control unit configured to display, in the display unit, the operation corresponding content corresponding to the operational code that has been received by the operational code receiving unit, and a list of next option contents corresponding to the operational codes of the next options associated with the operation corresponding content.

Embodiment (2)

One or more embodiments of the present invention provides the sewing machine system according to Embodiment (1), wherein the terminal device includes a confirming unit configured to confirm a model and a version of firmware of the sewing machine.

Embodiment (3)

One or more embodiments of the present invention provides the sewing machine system according to Embodiment (1), wherein the terminal device includes an operational code requesting unit configured to request the sewing machine for an operational code, and the operational code transmitting unit of the sewing machine transmits the operational code to the terminal device in response to the request from the operational code requesting unit.

Embodiment (4)

One or more embodiments of the present invention provides the sewing machine system according to Embodiment (3), wherein the operational code requesting unit requests the sewing machine for an operational code every predetermined time period, and the display control unit updates the operation corresponding content and the list displayed in the display unit, as the operational code received from the operational code receiving unit changes.

Embodiment (5)

One or more embodiments of the present invention provides the sewing machine system according to Embodiment (4), wherein the display control unit stops updating a content that is currently displayed when a user is determined to be viewing the operation corresponding content.

Embodiment (6)

One or more embodiments of the present invention provides the sewing machine system according to Embodiment (5), wherein the display control unit updates the list that is currently displayed even when the user is determined to be viewing the operation corresponding content.

Embodiment (7)

One or more embodiments of the present invention provides the sewing machine system according to Embodiment (4), wherein when a user is determined to have selected from the list and be viewing a detailed content, the display control unit stops updating the detailed content that is the content currently displayed.

Embodiment (8)

One or more embodiments of the present invention provides the sewing machine system according to Embodiment (5), wherein the sewing machine includes a sewing-machine-side display unit, and the operational code is assigned corresponding to each of screen contents displayed by the sewing machine.

Embodiment (9)

One or more embodiments of the present invention provides a sewing machine connected in a manner providing a capability of wireless communication with a terminal device, the sewing machine provided with: a sewing-machine-side wireless communication unit having a capability of wireless communication at least with the terminal device; a status grasping unit configured to grasp an operational status of the sewing machine; and an operational code transmitting unit configured to transmit an operational code to the terminal device, the operational code being assigned to the operational status grasped by the status grasping unit.

Embodiment (10)

One or more embodiments of the present invention provides a terminal device connected in a manner providing a capability of wireless communication with a sewing machine, the terminal device provided with: a display unit; a terminal-side wireless communication unit having a capability of wireless communication at least with the sewing machine; a recording unit recording after associating between the operation corresponding content corresponding to the operational code respectively assigned to operational statuses of the sewing machine and, the operational codes of a plurality of next options; an operational code receiving unit configured to receive an operational code from the sewing machine; and a display control unit configured to display, in the display unit, one of the operation corresponding contents corresponding to the operational code that has been received by the operational code receiving unit, and a list of next option contents corresponding to the operational codes of the next options associated with the one of the operation corresponding contents.

Embodiment (11)

One or more embodiments of the present invention provides a method of displaying a content for a sewing machine system having a sewing machine and a terminal device connected in a manner providing a capability of wireless communication with each other, the method provided with: a step of, by a status grasping unit, grasping an operational status of the sewing machine; a step of, by an operational code transmitting unit, transmitting an operational code to the terminal device, the operational code being assigned to the operational status grasped by the status grasping unit; a step of, by an operational code receiving unit, receiving the operational code from the sewing machine; and a step of, by a display control unit, displaying, in a display unit, an operation corresponding content corresponding to the operational code that has been received by the operational code receiving unit, and a list of next option contents corresponding to operational codes of next options associated with the operation corresponding content.

Embodiment (12)

One or more embodiments of the present invention provides a recording medium storing a program for a sewing machine connected to a terminal device in a manner providing a capability of wireless communication, the program causing a computer to execute: a step of, by a status grasping unit, grasping an operational status of the sewing machine; and a step of, by an operational code transmitting unit, transmitting an operational code to the terminal device, the operational code being assigned to the operational status grasped by the status grasping unit.

Embodiment (13)

One or more embodiments of the present invention provides a recording medium storing a program for a terminal device connected to a sewing machine in a manner providing a capability of wireless communication, the program causing a computer to execute: a step of, by an operational code receiving unit, receiving an operational code from the sewing machine; and a step of, by a display control unit, displaying, in a display unit, an operation corresponding content corresponding to the operational code that has been received by the operational code receiving unit, and a list of next option contents corresponding to operational codes of next options associated with the operation corresponding content.

According to the one or more embodiments of the present invention, it is possible to provide a sewing machine system capable of displaying contents such as operational instructions in a terminal device at appropriate timing according to a status of a sewing machine without requiring complicated operation, the sewing machine, the terminal device, a method of displaying a content for the sewing machine system, a recording medium storing a program for the sewing machine, and a recording medium storing a program for the terminal device.

BRIEF DESCRIPTION OF THE DRAWINGS

FIG. 3 shows configurations of tables in each of which a screen code, a name of a content file, and a list of screen codes of next options are described;

DETAILED DESCRIPTION OF PREFERRED EMBODIMENTS

Hereinafter, an exemplary embodiment for implementing the present invention will be described with reference to the drawings.

Exemplary Embodiment

Figure 1:
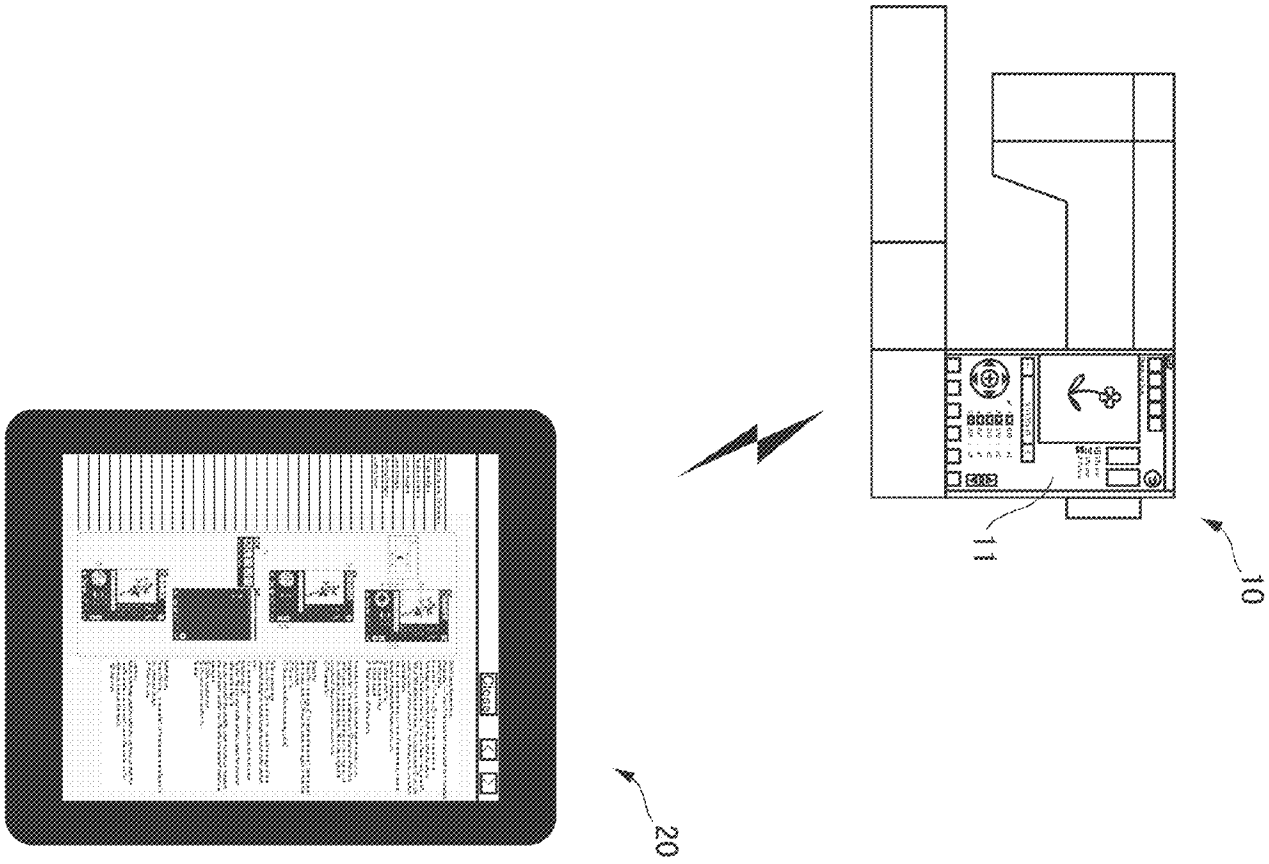
FIG. 1 is a diagram illustrating an exemplary embodiment of a sewing machine system according to the present invention.

FIG. 1 is a diagram illustrating an exemplary embodiment of a sewing machine system according to the present invention.

Figure 2:
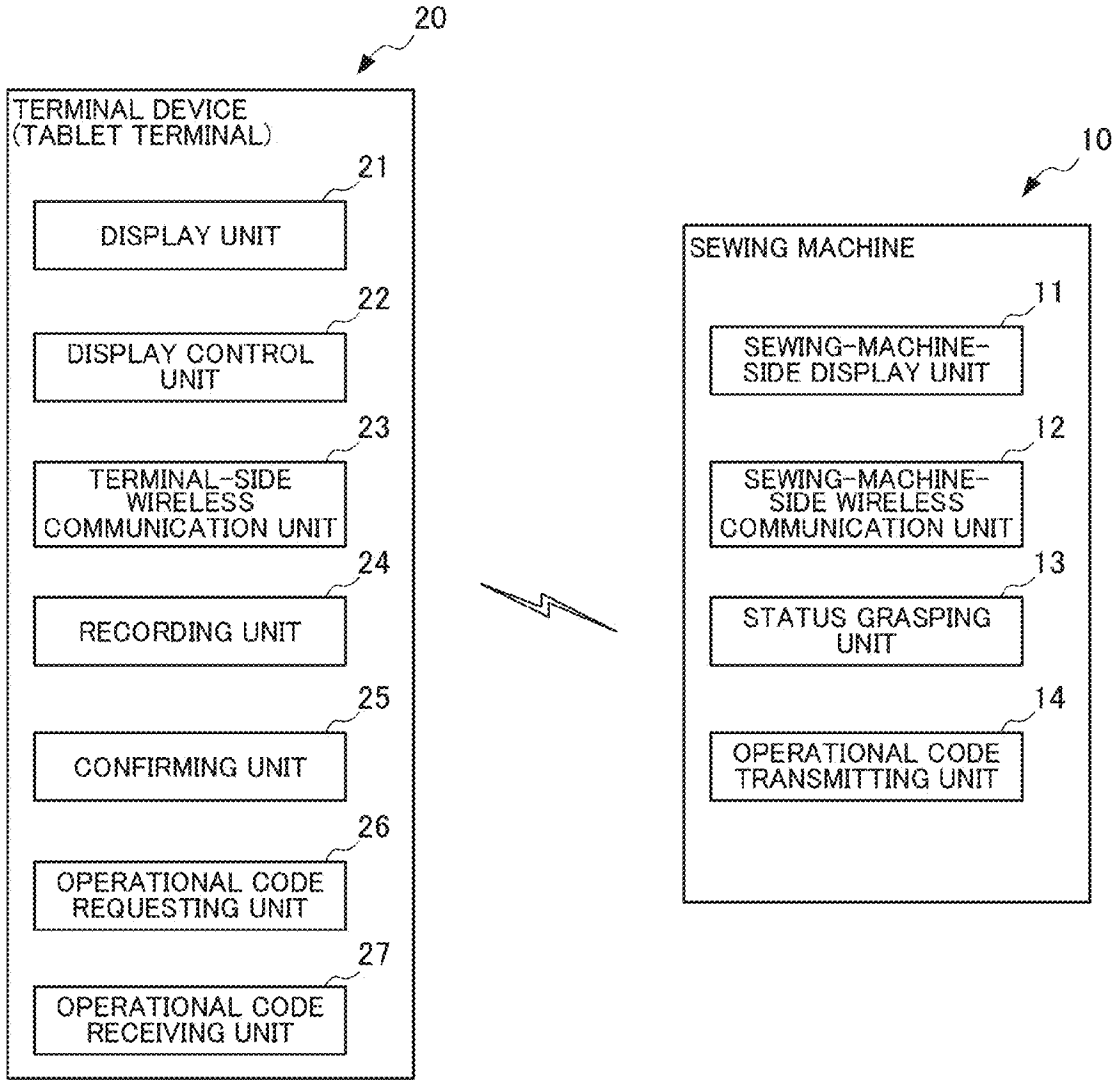
FIG. 2 is a block diagram illustrating control configurations of a sewing machine 10 and a tablet terminal 20.

FIG. 2 is a block diagram illustrating control configurations of a sewing machine 10 and a tablet terminal 20.

The following figures including FIG. 1 and FIG. 2 are schematic diagrams, in which sizes and shapes of components are shown figuratively if appropriate in order to facilitate understanding.

Further, while specific values, shapes, operations, and the like are referred in the following description, these are mere examples and may be modified as appropriate.

the sewing machine system according to this exemplary embodiment includes the sewing machine 10 and the tablet terminal 20 as a terminal device, and the sewing machine 10 and the tablet terminal 20 are able to communicate with each other through a wireless LAN via a router or the like that is not shown.

The sewing machine 10 is able to perform embroidery semi-automatically according to embroidery data, using threads of a plurality of colors, for example. The sewing machine 10 is a multi-functional sewing machine capable of performing normal sewing with various sewing patterns.

The sewing machine 10 includes a sewing-machine-side display unit 11, a sewing-machine-side wireless communication unit 12, a status grasping unit 13, and an operational code transmitting unit 14.

The sewing-machine-side display unit 11 is provided for the sewing machine 10 itself, and configured by a liquid crystal display device, for example. In the sewing-machine-side display unit 11, various information useful for a user is displayed according to an operational status of the sewing machine. For example, in a state in which needle threading is performed, information that may help needle threading operation is displayed. As the sewing machine is multi-functional, the content that is displayed has a number of variations.

The sewing-machine-side wireless communication unit 12 is connected to the wireless LAN, and is able to perform wireless communication mutually with the tablet terminal 20 via a router or the like that is not shown.

The status grasping unit 13 grasps the operational status of the sewing machine 10, and transmits the grasped operational status to the operational code transmitting unit 14.

The operational code transmitting unit 14 transmits a screen code as an operational code assigned to the operational status grasped by the status grasping unit 13 to the tablet terminal 20 via the sewing-machine-side wireless communication unit 12.

Here, the screen code will be described. As described above, the content displayed in the sewing-machine-side display unit 11 has a number of variations, and the displayed content varies according to the operational status of the sewing machine. Further, all of the contents to be displayed are respectively assigned with unique numbers called screen codes. Therefore, in this exemplary embodiment, the status grasping unit 13 substantially grasps the operational status of the sewing machine by obtaining a screen code of the content displayed in the sewing-machine-side display unit 11. Further, in this exemplary embodiment, the obtained screen code is treated as the operational code, and used as an index indicating the operational status of the sewing machine.

Here, the status grasping unit 13 and the operational code transmitting unit 14 may be realized by a CPU as a computer functioning as a control unit of the sewing machine 10.

As the tablet terminal 20, a general-purpose product that is commonly available may be used. In order to use the tablet terminal 20 as a terminal device according to this exemplary embodiment, a program for the sewing machine system is installed in the tablet terminal 20 and executed. This program may be recorded in a recording medium such as a flash memory device, or may be downloaded through various known networks.

The tablet terminal 20 includes a display unit 21, a display control unit 22, a terminal-side wireless communication unit 23, a recording unit 24, a confirming unit 25, an operational code requesting unit 26, and an operational code receiving unit 27.

The display unit 21 is configured to serve as a touch panel, with which various input may be performed in addition to display of information.

The display control unit 22 controls the content displayed in the display unit 21. In particular, the display control unit 22 according to this exemplary embodiment displays, in the display unit 21, an operation corresponding content, which corresponds to the operational code received by the operational code receiving unit 27, and a list of next option contents respectively corresponding to operational codes of next options associated with the operation corresponding content. A display operation performed by the display control unit 22 will be described later.

Hereinafter, the operation corresponding content and the next option contents will be described. The tablet terminal 20 according to this exemplary embodiment includes contents respectively corresponds to a large number of screen codes described above. As specific contents, HTML (Hyper Text Markup Language) documents (files) regarding operational instructions of the sewing machine are prepared, and the number of the prepared HTML documents is the same as the number of the screen codes. Each of a large number of contents has a file name, and is associated one to one with a screen code described above and stored in the recording unit 24. These contents are not limited to the HTML documents, and text data, image data, moving image data, audio data, or the like may be used as appropriate.

Among these, a content corresponding to the screen code that corresponds to the content displayed in the sewing-machine-side display unit 11 is herein referred to as the operation corresponding content.

Further, the screen code of the operation corresponding content is associated with a screen code of at least one next option. The screen code of the next option is a screen code set corresponding to the content that is displayed in the sewing-machine-side display unit 11 during operation of the sewing machine and that is related to the operation corresponding content or expected to be performed.

FIG. 3 shows configurations of tables in each of which a screen code, a name of a content file, and a list of screen codes of next options are described.

As illustrated in FIG. 3, the recording unit 24 records, as a table, a screen code, a name of a content file, and a list of screen codes of next options. In this exemplary embodiment, 200-byte fixed-length tables are listed in ascending order of the screen codes. The length of the screen code is 4 bytes.

In this exemplary embodiment, the contents are instructions of the sewing machine, and explanatory text for the instructions is described in HTML (HyperText Markup Language). An application program of the system contains all of html files corresponding to the screen codes. In the example illustrated in FIG. 3, the explanatory text is described in detail along with illustrations in files such as StartingToSewEmbroidery.html, EditingMode.html, and CutWorkDesign.html.

The terminal-side wireless communication unit 23 is connected to the wireless LAN, and is able to perform wireless communication mutually with the sewing machine 10 via a router or the like that is not shown.

After the application program of this system is started up on the tablet terminal 20, the confirming unit 25 first confirms a model and a version of firmware of the sewing machine 10 that is wirelessly connected. Then, the confirming unit 25 determines whether or not the application program of this system supports the model and the version of firmware of the sewing machine 10 that is wirelessly connected.

The operational code requesting unit 26 requests the sewing machine 10 for the operational code every predetermined time period. The operational code requesting unit 26 according to this exemplary embodiment requests the sewing machine 10 for the operational code every three seconds.

The operational code receiving unit 27 receives the operational code transmitted from the operational code transmitting unit 14 of the sewing machine 10. The received operational code is transmitted to the display control unit 22.

Figure 4:
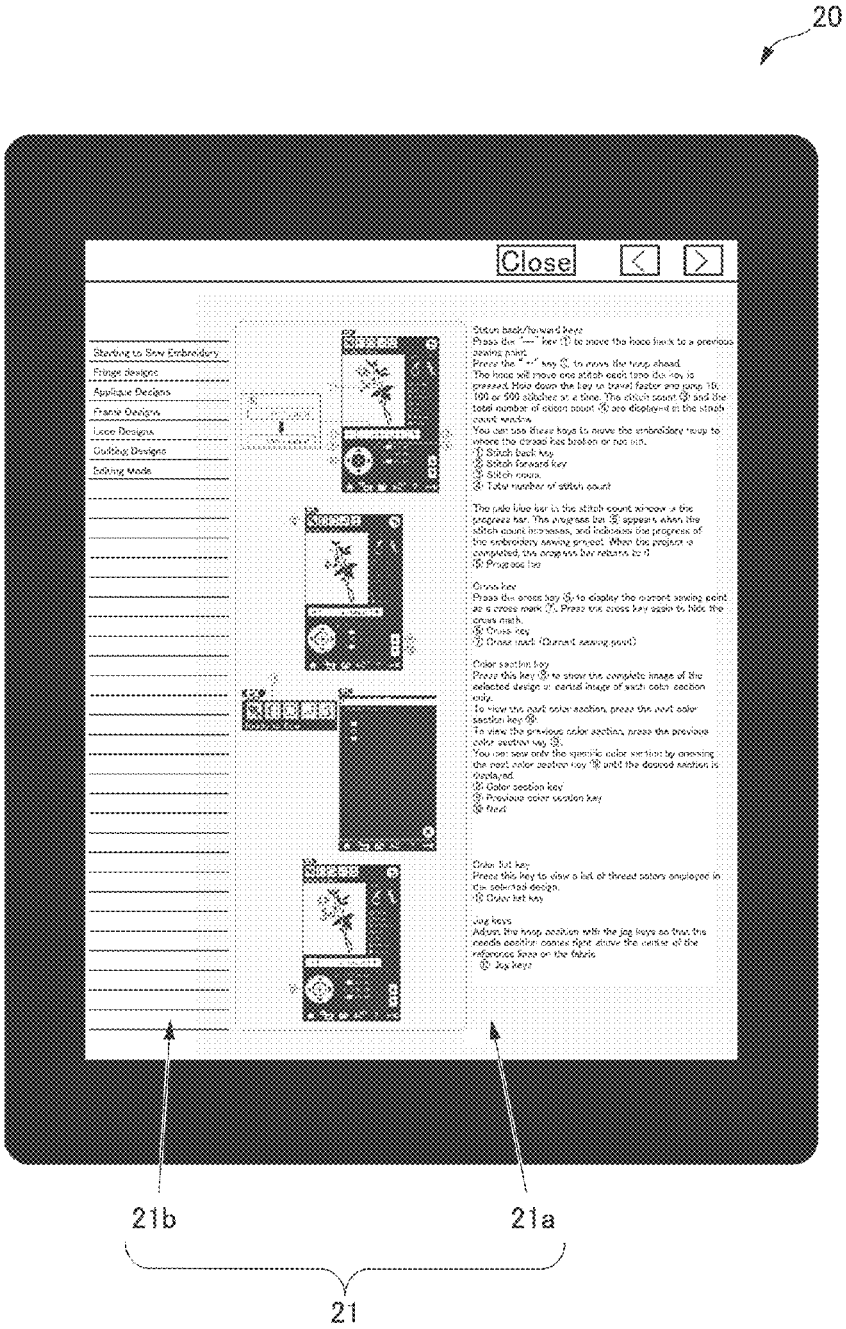
FIG. 4 is a view illustrating an example of display in a display unit 21 of the tablet terminal 20.

FIG. 4 is a view illustrating an example of display in the display unit 21 of the tablet terminal 20.

The information of the tables recorded in the recording unit 24 is displayed in a main screen 21*a* and a sub screen 21*b* of the display unit 21 during running of the application program of this system. The display unit 21 is divided into a left part and a right part, and the right part is the main screen 21*a* in which detailed explanatory text specified by the screen code are displayed. The left part of the display unit 21 is the sub screen 21*b*, in which a list of titles of item options related to the main screen 21*a* is displayed. The displayed content is updated in real time in conjunction with operation of the sewing machine 10. However, the update of the main screen 21*a* stops if viewing operation is performed such as flipping pages using a "<" or ">" button, scrolling the screen, or selecting the list of options, and it is possible to continue viewing operation. It should be noted that the list of options in the sub screen 21*b* is always updated in conjunction with the sewing machine 10. Further, the titles used in the list of options are titles of the HTML files respectively corresponding to the screen codes.

Figure 5:
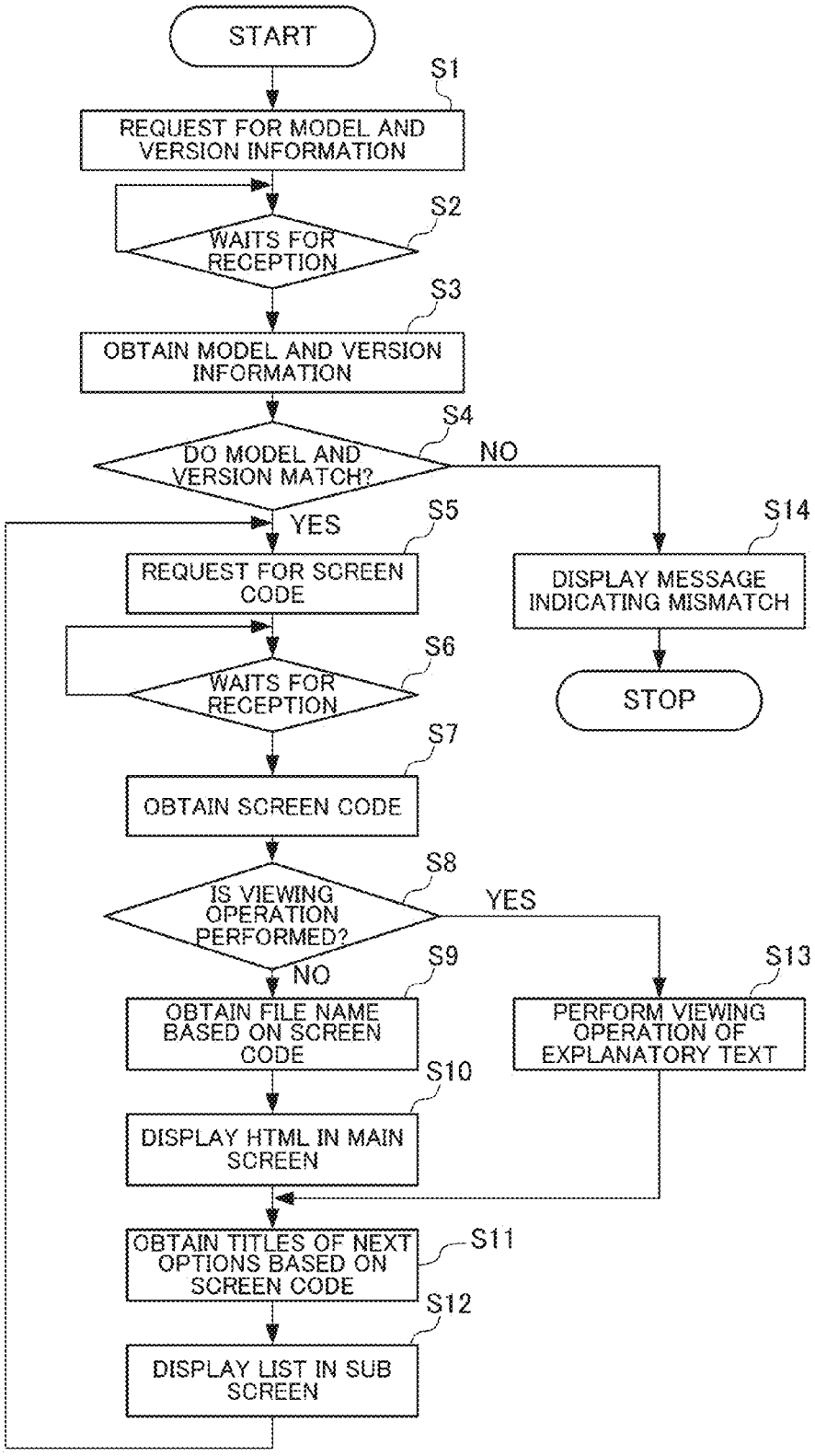
FIG. 5 is a flowchart showing a flow of operation of the tablet terminal 20 according to this exemplary embodiment.

FIG. 5 is a flowchart showing a flow of the operation of the tablet terminal 20 according to this exemplary embodiment.

In the following, the operation of the tablet terminal 20 will be described with reference to FIG. 5.

Here, the sewing machine 10 and the tablet terminal 20 are connected via a router that is not shown, and are able to communicate with each other through a wireless LAN by previously having cryptosystems match and setting a password on either side.

Upon starting up the application program on the tablet terminal 20, in Step (hereinafter referred to as S) 1, the tablet terminal 20 transmits, to the sewing machine 10, a request command for information on the model and information on the version of firmware, and waits for a response in S2.

In S3, the information on the model and the information on the version of firmware of the sewing machine 10 are received.

In S4, it is confirmed that the information on the model and the information on the version of firmware that have been received in S3 match to a model and a version of the instruction files (content files) contained in the application program. If the information on the model and the information on the version of firmware that have been received do not match to the model and the version of the application program, the operation moves to S14, a message indicating mismatch is displayed, and the application program is stopped. On the other hand, if the information on the model and the information on the version of firmware that have been received match to the model and the version of the application program, the operation moves to S5, and displaying of the instruction content in the tablet terminal 20 is started.

In S5, the tablet terminal 20 transmits, to the sewing machine 10, a request command for a screen code, and waits for reception of the code in S6.

In S7, the tablet terminal 20 obtains (receives) the screen code transmitted from the sewing machine 10.

In S8, the tablet terminal 20 determines whether or not viewing operation of operational instructions is currently performed. If not, the operation moves to S9, and search is performed in the tables in FIG. 3 held in the application program by the received screen code, and a name of a file in which explanatory text is described is obtained. Then, the operation moves to S10, and the content in an html format is displayed in the main screen 21*a*.

Further, a screen code of a next option registered in the table searched by the screen code is obtained. A name of an html file is obtained based on the screen code, and a title name described at the head of the file is obtained. This operation is repeated by the number of next options registered in the table, and thus a list of the names of the next options is displayed in the sub screen.

On the other hand, if the viewing operation is performed, the operation of the tablet terminal 20 moves to S13 without updating the explanatory text displayed in the main screen 21*a*, and the viewing operation is kept continued. During the viewing operation, the display in the sub screen 21*b* is updated in S11 and in S12. After the operation in S12, the operation moves to S5.

The operation from S5 to S12 is performed at intervals of several seconds (e.g., 3 seconds), and the content displayed in the display unit 21 of the tablet terminal 20 is updated to a more detailed instruction screen corresponding to the screen of the sewing-machine-side display unit 11, at the same time as the sewing machine 10 is operated and the screen of the sewing-machine-side display unit 11 changes.

Figure 6:
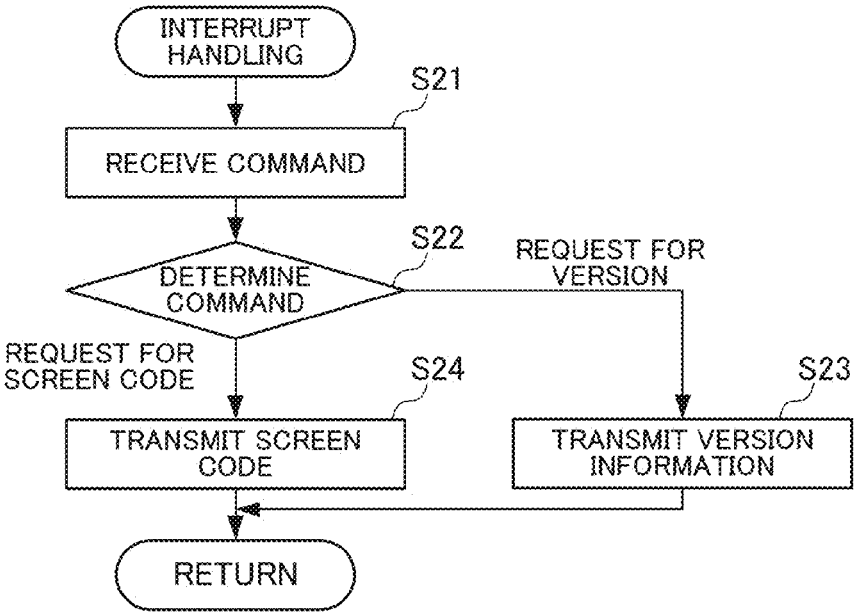
FIG. 6 is a flowchart showing interrupt handling of communication by the sewing machine 10.

FIG. 6 is a flowchart showing interrupt handling of communication by the sewing machine 10.

Upon reception of a command from the tablet terminal 20, the sewing machine 10 starts interrupt handling.

In S21, the sewing machine 10 receives a command from the tablet terminal 20.

In S22, the sewing machine 10 determines the command, and the operation moves to S23 if the model information and the version information are requested, and the sewing machine 10 transmits a model code and a version number of the firmware of the sewing machine 10, the tablet terminal 20 and is resumed from the interrupt handling. On the other hand, the operation moves to S24 if the screen code is requested, and the sewing machine 10 transmits, to the tablet terminal 20, the screen code of the screen currently displayed by the sewing machine 10 and is resumed from the interrupt handling.

Figure 7:
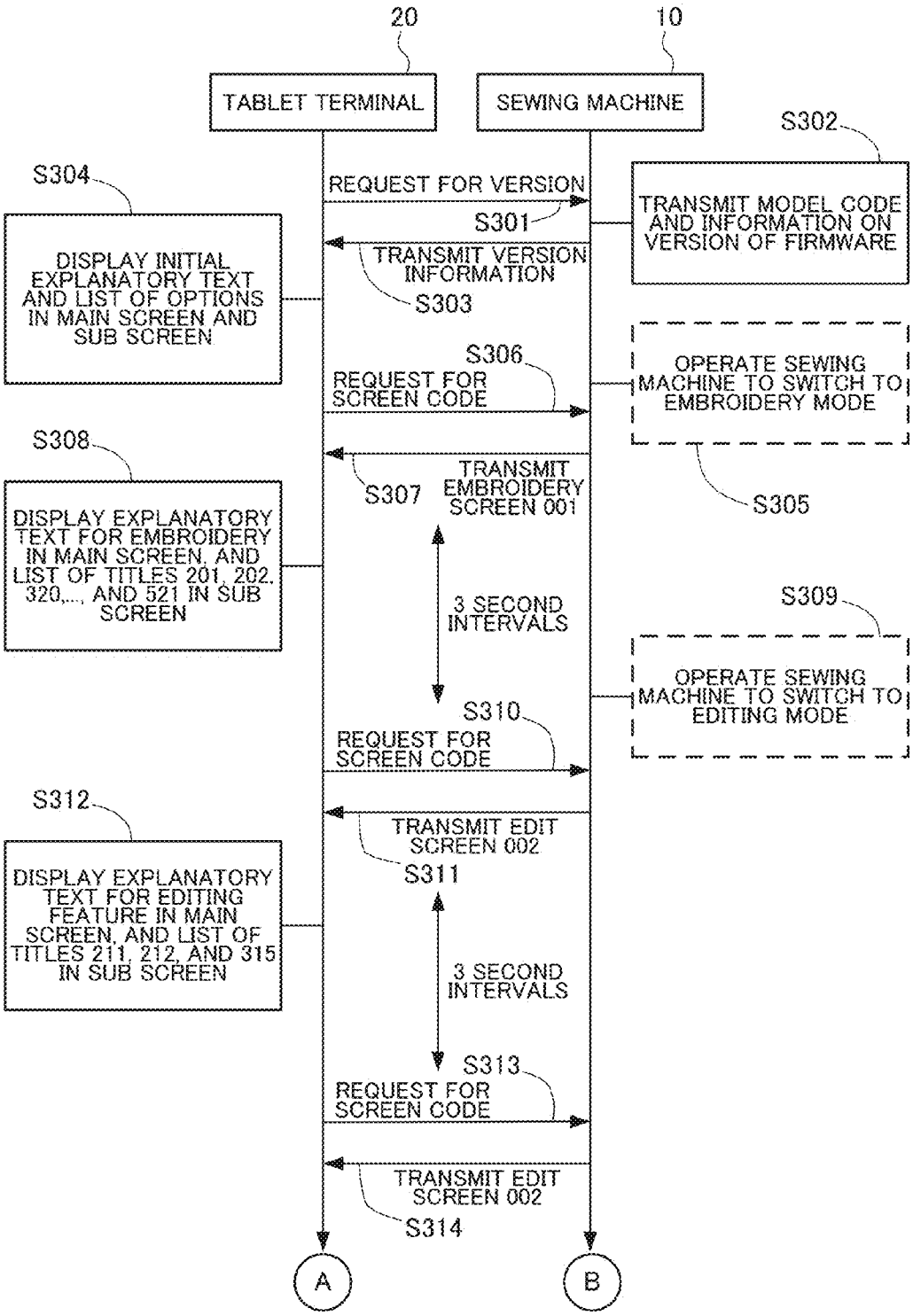
FIG. 7 is a sequence diagram showing one example of command and data transmission between the sewing machine 10 and the tablet terminal 20 as well as operation of the sewing machine 10 and the tablet terminal 20.
Figure 8:
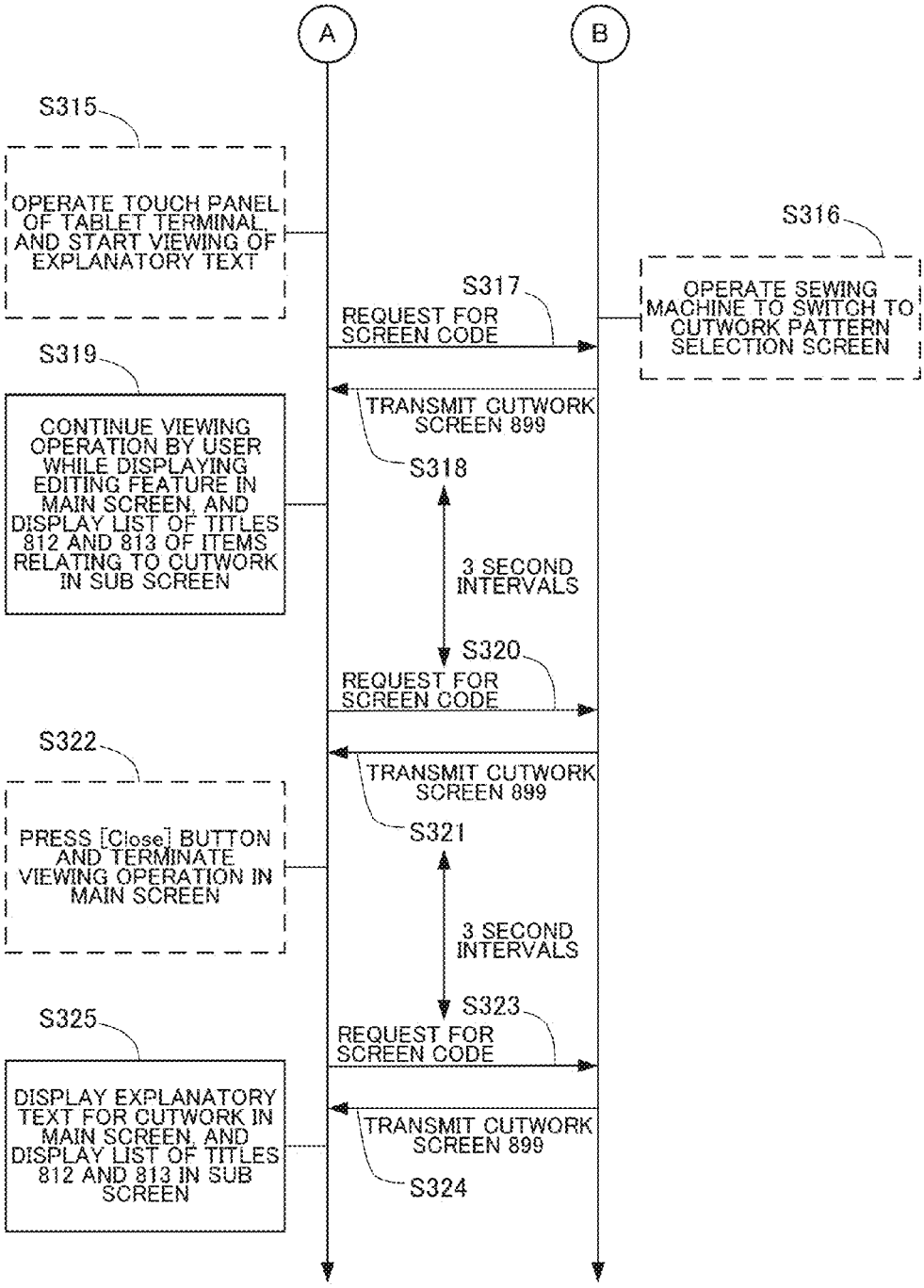
FIG. 8 is a sequence diagram showing one example of command and data transmission between the sewing machine 10 and the tablet terminal 20 as well as operation of the sewing machine 10 and the tablet terminal 20.

FIG. 7 and FIG. 8 are sequence diagrams each showing one example of command and data transmission between the sewing machine 10 and the tablet terminal 20 as well as operation of the sewing machine 10 and the tablet terminal 20. In FIG. 7 and FIG. 8, an operation in a square with dashed line represents an operation by the user.

The tablet terminal 20 obtains the model information and the version information in initial communication (S301, S302, and S303), and continues the communication if the model code and the version number of the sewing machine 10 are predetermined ones.

Initially when starting the application program, the tablet terminal 20 displays initial explanatory text and a list of options in the main screen 21*a* and the sub screen 21*b* (S304).

In response to the request for the screen code, the sewing machine 10 returns the screen code previously defined for the currently displayed screen. Such communication is performed repeatedly at intervals of 3 seconds, for example.

When the user operates the sewing machine 10 and an operational mode of the sewing machine 10 is switched to an embroidery mode (S305), based on a subsequent request for the screen code (S306), the sewing machine 10 returns a code 001 representing the embroidery screen to the tablet terminal (S307).

Next, the tablet terminal 20 searches for the screen code 001 through the tables, obtains a file name StartingToSewEmbroidery.html, and displays a content of the file in the main screen 21*a*. In addition, as the screen codes of the next options are described in the same table, the tablet terminal 20 obtains file names, extracts title names at the head of the files, and displays the title names in a list in the sub screen 21*b* in the same manner described above. In the example shown in FIG. 7, the title names of the screen codes 201, 202, 320, . . . , and 521 are displayed in a list in the sub screen 21*b* (S308).

Then, it is assumed that the user operates the sewing machine 10 and the screen is switched to the edit screen (S309).

Subsequently, the tablet terminal 20 obtains the screen code in communication performed at intervals of 3 seconds (S310 and S311). As a screen code 002 corresponding to the edit screen is obtained, the tablet terminal 20 obtains a file name EditingMode.html from the table, and displays a content of the file in the main screen 21*a*. In the sub screen 21*b*, a list of item names obtained from screen codes 211, 212, and 315 are displayed (S312).

Even though communication is performed at intervals of 3 seconds (S313 and S314) after this, the display is not updated as the obtained screen code (screen code 002) is unchanged.

Next, it is assumed that the user operates the touch panel of the display unit 21 of the tablet terminal 20 to flip pages or scroll the explanatory text for an editing feature (S315). At this time, an internal state of the tablet terminal 20 is switched to a viewing mode, and this state is maintained.

Then, it is assumed that the user operates the sewing machine 10 and the screen is switched to a screen for a cutwork feature (S316).

In communication performed thereafter at intervals of 3 seconds (S317 and S318), the tablet terminal 20 obtains a screen code 899, but the explanatory text in the main screen 21*a* is not updated as the tablet terminal 20 is in the viewing mode. On the other hand, the sub screen 21*b* displays a list of titles of content items that are next options relating to the cutwork (S319).

In subsequent communication performed at intervals of 3 seconds (S320 and S321), the tablet terminal 20 obtains the screen code 899, but the explanatory text in the main screen 21*a* is not updated as the tablet terminal 20 is still in the viewing mode.

Next, it is assumed that the user presses a [Close] button in order to terminate the viewing operation by the application program on the tablet terminal 20 (S322).

While the screen code obtained in communication performed thereafter at intervals of 3 seconds (S323 and S324) is still 899 for the cutwork feature, a content of CutWorkDesign.html is displayed in the main screen 21*a* as the viewing mode is terminated. The titles of the items relating to the cutwork remain displayed in the sub screen 21*b*.

Now, configurations and effects of the sewing machine system, the sewing machine, the terminal device, the method of displaying a content for the sewing machine system, the recording medium storing a program for the sewing machine, and the recording medium storing a program for the terminal device according to this exemplary embodiment described above are listed in the following.

(1) The sewing machine 10 and the tablet terminal 20 are connected so as to be able to wirelessly communicate with each other (e.g., wireless LAN).

(2) In initial communication, the tablet terminal 20 obtains the model and the version number of firmware of the sewing machine 10, and confirms that the model and the version for the explanatory text contained in the application program on the tablet terminal 20 match to the model and the version of the sewing machine 10.

(3) For each of the screens that may be displayed by the sewing machine 10, a screen code is previously defined (such as a number or a keyword specifying each screen, and used as the operational code representing the operational status of the sewing machine), and the sewing machine 10 returns the screen code in response to a query from the tablet terminal 20.

(4) The tablet terminal 20 makes a query to the sewing machine 10 at intervals of several seconds, and the sewing machine 10 returns a screen code corresponding to the sewing-machine-side display unit 11 (operation screen) at an instance the query is made.

(5) The display unit 21 of the tablet terminal 20 includes the main screen 21*a* for displaying detailed instructions, and the sub screen 21*b* for displaying a list of next options that are expected to be selected next by the user (item names (such as titles) of a second option, a third option, . . . ).

(6) The tablet terminal 20 displays explanatory text or the like that is previously defined based on the screen code received from the sewing machine 10. Examples of the content include, not limited to text, moving images and sound.

(7) When the screen of the sewing-machine-side display unit 11 changes as the sewing machine 10 is operated, the screen code also changes correspondingly. In other words, according to the operation of the sewing machine 10, the content displayed in the main screen 21*a* of the tablet terminal 20 changes as needed.

(8) As the main screen 21*a* changes, the list of options displayed in the sub screen 21*b* also changes as needed.

(9) When performing the viewing operation of the explanatory text displayed in the main screen 21*a* (e.g., flipping pages, scrolling, pressing down of the [Close] button, or the like), automatic update of the explanatory text in the main screen 21*a* stops, and the display in the main screen 21*a* of the tablet terminal 20 remains unchanged even when the sewing machine 10 is operated and the screen of the sewing-machine-side display unit 11 changes.

(10) The automatic update temporarily stops when the list of options in the sub screen 21*b* is selected to change the screen to a details screen. However, even in such a case, the main screen 21*a* is again automatically updated when the [Close] button is pressed to close the detail screen.

As described above, according to this exemplary embodiment, the tablet terminal 20 is informed of a current state of the display screen of the sewing-machine-side display unit 11 of the sewing machine 10, and the tablet terminal 20 displays explanatory text that is best suited for the current state of the sewing machine 10. The tablet terminal 20 obtains the current state from the sewing machine 10 at regular intervals as the screen code, and displays explanatory text corresponding to the screen code as needed. Therefore, the user is able to read explanatory text and see illustrations (including moving images) that are related to a current operation of the sewing machine only by looking at the screen of the tablet terminal 20. Further, as the second, third, and the like options related to the current state of the sewing machine are also displayed in a list, the user is able to see detailed text only by selecting the desired item. As detailed explanatory text that is expected to be best suited and next options are displayed on the tablet terminal 20 without the user looking up each time as in the case of the printed instruction manual or the online help, the user only has to select the options. Thus, according to this exemplary embodiment, it is possible to provide a user who does not read the instruction manual as feeling too much pain in finding a corresponding item with explanatory text without much trouble. With this, it is possible to reduce cases in which the user does not understand how to operate the sewing machine and is not able to use the sewing machine.

Similarly to the case of the tablet terminal, it is also possible to realize the sewing machine system, the sewing machine, and the method of displaying a content for the sewing machine system according to the present invention by having the process of the sewing machine be recorded in a computer-readable recording medium, and by having a computer of the sewing machine read and execute a program recorded in the recording medium. As used herein, the computer includes an OS and hardware such as peripheral devices.

Further, the program may be transmitted from the computer having the program stored in a storage device or the like to another computer via a transmission medium or by transmitted waves in the transmission medium. As used herein, the "transmission medium" that transmits the program refers to a medium having a function for transmitting information, like a network (communication network) such as the Internet or a telecommunication line (communication line) such as telephone line.

Moreover, the program may be for realizing a part of the function described above. In addition, the program may be a so-called difference file (difference program) with which the functions described above may be achieved in combination with a program that is already recorded in the computer.

Modified Embodiment

The present invention is not limited to the exemplary embodiment described above, and may be modified or altered in various ways, which are also included within the scope of the present invention.

In this exemplary embodiment, the example in which a tablet terminal is used as the terminal device is described. The present invention is not limited to such an example, and a personal computer or a gaming machine may be used as the terminal device, for example. As long as the application program can be executed and wireless communication with the sewing machine is possible, a terminal device of any configuration may be used.

In this exemplary embodiment, the example in which the sewing machine and the tablet terminal communicate through a wireless LAN is described. The present invention is not limited to such an example, and it is possible to use a different type of wireless communication, such as infrared communication or Bluetooth (registered trademark), for example.

In this exemplary embodiment, the example in which a screen code is requested from the tablet terminal to the sewing machine and the sewing machine transmits the current screen code in response to the request is described. The present invention is not limited to such an example, and the sewing machine is configured to transmit the screen code to the tablet terminal always when there is a change in the screen of sewing machine, so the request for a screen code from the tablet terminal is not required, for example.

In this exemplary embodiment, the example in which the screen code is transmitted from the sewing machine to the tablet terminal as the operational code is described. The present invention is not limited to such an example, and the operational codes may be set more finely instead of making one-to-one correspondence between the display screens and the operational codes, for example. In this case, the operational codes may be set separately from the screen codes, and an operational code itself may be transmitted from the sewing machine to the tablet terminal.

While the exemplary embodiment and the modified embodiment may be used in an appropriate combination, detailed descriptions shall be omitted. Further, the present invention is not limited to the embodiments described above.

REFERENCE SIGNS LIST

10: sewing machine
11: sewing-machine-side display unit
12: sewing-machine-side wireless communication unit
13: status grasping unit
14: operational code transmitting unit
20: tablet terminal
21: display unit
21*a*: main screen
21*b*: sub screen
22: display control unit
23: terminal-side wireless communication unit
24: recording unit
25: confirming unit
26: operational code requesting unit
27: operational code receiving unit

What is claimed is:

1. A sewing machine system comprising:
a sewing machine; and
a terminal device, wherein
the sewing machine and the terminal device are configured to wirelessly communicate with each other,
the sewing machine includes:
a sewing-machine-side wireless communication unit having a capability of wireless communication at least with the terminal device;
a status grasping unit configured to grasp that a needle threading is performed, as an operational status of the sewing machine, in a state in which the needle threading is performed; and
an operational code transmitting unit configured to transmit an operational code to the terminal device, the operational code being assigned to the operational status grasped by the status grasping unit, and
the terminal device includes:
a display unit;
a terminal-side wireless communication unit having a capability of wireless communication at least with the sewing machine;
a recording unit recording after associating between an operation of the needle threading corresponding content corresponding to the operational code and, operational codes of a plurality of next options;
an operational code receiving unit configured to receive the operational code from the sewing machine; and
a display control unit configured to display, in the display unit, the operation corresponding content corresponding to the operational code that has been received by the operational code receiving unit, and a list of next option contents corresponding to the operational codes of the next options associated with the operation corresponding content.

2. The sewing machine system according to claim 1, wherein
the terminal device includes a confirming unit configured to confirm a model and a version of firmware of the sewing machine.

3. The sewing machine system according to claim 1, wherein
the terminal device includes an operational code requesting unit configured to request the sewing machine for an operational code, and
the operational code transmitting unit of the sewing machine transmits the operational code to the terminal device in response to the request from the operational code requesting unit.

4. The sewing machine system according to claim 3, wherein
the operational code requesting unit requests the sewing machine for an operational code every predetermined time period, and
the display control unit updates the operation corresponding content and the list displayed in the display unit, as the operational code received from the operational code receiving unit changes.

5. The sewing machine system according to claim 4, wherein
the display control unit stops updating a content that is currently displayed when a user is determined to be viewing the operation corresponding content.

6. The sewing machine system according to claim 5, wherein
the display control unit updates the list that is currently displayed even when the user is determined to be viewing the operation corresponding content.

7. The sewing machine system according to claim 4, wherein
when a user is determined to have selected from the list and be viewing a detailed content, the display control unit stops updating the detailed content that is the content currently displayed.

8. The sewing machine system according to claim 1, wherein
the sewing machine includes a sewing-machine-side display unit, and
the operational code is assigned corresponding to each of screen contents displayed by the sewing machine.

9. A sewing machine configured to wirelessly communicate with a terminal device, the sewing machine comprising:
a sewing-machine-side wireless communication unit having a capability of wireless communication at least with the terminal device;
a status grasping unit configured to grasp that a needle threading is performed, as an operational status of the sewing machine, in a state in which the needle threading is performed; and
an operational code transmitting unit configured to transmit an operational code to the terminal device, the operational code being assigned to the operational status grasped by the status grasping unit.

10. A terminal device configured to wirelessly communicate with a sewing machine, the terminal device comprising:
a display unit;
a terminal-side wireless communication unit having a capability of wireless communication at least with the sewing machine;
a recording unit recording after associating between an operation corresponding content corresponding to an operational code assigned to operational statuses of the sewing machine and, operational codes of a plurality of next options, wherein one of the operational statuses is defined as a state in which a needle threading is performed;

an operational code receiving unit configured to receive an operational code from the sewing machine; and a display control unit configured to display, in the display unit, the operation corresponding content corresponding to the operational code that has been received by the operational code receiving unit, and a list of next option contents corresponding to the operational codes of the next options associated with the one of the operation corresponding contents.

11. A method of displaying a content for a sewing machine system having a sewing machine and a terminal device configured to wirelessly communicate with each other, the method comprising:

a step of, by a status grasping unit, grasping that a needle threading is performed, as an operational status of the sewing machine, in a state in which the needle threading is performed;

a step of, by an operational code transmitting unit, transmitting an operational code to the terminal device, the operational code being assigned to the operational status of the needle threading grasped by the status grasping unit;

a step of, by an operational code receiving unit, receiving the operational code from the sewing machine; and a step of, by a display control unit, displaying, in a display unit, an operation corresponding content corresponding to the operational code that has been received by the operational code receiving unit, and a list of next option contents corresponding to operational codes of next options associated with the operation corresponding content.

12. A non-transitory recording medium storing a program for a sewing machine connected to a terminal device in a manner providing a capability of wireless communication, the program causing a computer to execute:

a step of, by a status grasping unit, grasping that a needle threading is performed, as an operational status of the sewing machine, in a state in which the needle threading is performed; and a step of, by an operational code transmitting unit, transmitting an operational code to the terminal device, the operational code being assigned to the operational status of the needle threading grasped by the status grasping unit.

13. A non-transitory recording medium storing a program for a terminal device connected to a sewing machine in a manner providing a capability of wireless communication, the program causing a computer to execute:

a step of, by an operational code receiving unit, receiving an operational code from the sewing machine, the operational code being associated with an operation of a needle threading by the sewing machine; and a step of, by a display control unit, displaying, in a display unit, an operation corresponding content corresponding to the operational code that has been received by the operational code receiving unit, and a list of next option contents corresponding to operational codes of next options associated with the operation corresponding content.

* * * * *